US012735851B1

(12) United States Patent
Farner et al.

(10) Patent No.: US 12,735,851 B1
(45) Date of Patent: Sep. 15, 2026

(54) MOBILE BARRIER

(71) Applicants: Jeremy Brand Farner, Broomfield, CO (US); Bryce Christian Perkins, Broomfield, CO (US)

(72) Inventors: Jeremy Brand Farner, Broomfield, CO (US); Bryce Christian Perkins, Broomfield, CO (US)

( * ) Notice: Subject to any disclaimer, the term of this patent is extended or adjusted under 35 U.S.C. 154(b) by 931 days.

(21) Appl. No.: 17/850,653

(22) Filed: Jun. 27, 2022

Related U.S. Application Data

(60) Provisional application No. 63/215,886, filed on Jun. 28, 2021.

(51) Int. Cl.
*E01F 13/04* (2006.01)

(52) U.S. Cl.
CPC ..... *E01F 13/048* (2013.01); *E01F 13/046* (2013.01)

(58) Field of Classification Search
CPC ..... E04G 21/3233
See application file for complete search history.

(56) References Cited

U.S. PATENT DOCUMENTS 159,571 A * 2/1875 Fuchslocher et al. .. B66F 11/04 182/62.5
1,165,906 A * 12/1915 Rhoades ..... E01F 7/02 256/12.5
1,771,695 A * 7/1930 Tompkins ..... E04H 6/282 187/336
2,806,396 A * 9/1957 Miller ..... B25B 23/12 403/DIG. 1
3,880,405 A * 4/1975 Brueske ..... E04G 21/3285 248/237
4,480,819 A * 11/1984 Lopez ..... E04G 21/3233 182/113
5,295,557 A * 3/1994 Taylor ..... E02D 29/127 182/128
6,830,127 B2 * 12/2004 Johnson ..... E02D 29/12 182/128
7,063,186 B1 * 6/2006 Granke ..... E04G 21/3223 182/113
7,810,265 B2 * 10/2010 Beatty ..... G09F 7/18 40/607.14
8,042,652 B2 * 10/2011 Weir ..... A01M 31/02 182/187
D656,442 S * 3/2012 Hanks ..... D12/194
8,424,852 B2 * 4/2013 Anson ..... E04G 21/3219 256/45

(Continued)

FOREIGN PATENT DOCUMENTS

CN 223804851 U * 1/2026
CN 121516790 A * 2/2026 ..... B66C 1/16

(Continued)

*Primary Examiner* — Christopher J Sebesta
*Assistant Examiner* — Katherine J Chu
(74) *Attorney, Agent, or Firm* — Plager Schack LLP; Mark H. Plager; Michael J. O'Brien

(57) ABSTRACT

A mobile barrier assembly is configured to create a restricted space that moves with a working platform. The mobile barrier assembly has a working platform with four corners. A marker pole is attached to each corner. A barrier line is attached to an end of the marker pole. The barrier line creates the restricted space between the barrier line and the working platform.

1 Claim, 4 Drawing Sheets

(56) References Cited

U.S. PATENT DOCUMENTS

| | | | | |
|---|---|---|---|---|
| 8,479,962 | B2 * | 7/2013 | Hall | B60R 11/00 224/567 |
| 9,598,250 | B1 * | 3/2017 | Willard | B65G 69/2876 |
| 9,630,823 | B1 * | 4/2017 | Conway | B66F 7/0658 |
| 10,458,133 | B2 * | 10/2019 | Davis | E04H 17/009 |
| 11,168,835 | B2 * | 11/2021 | Chambers | F16M 11/048 |
| 2004/0154143 | A1 * | 8/2004 | Harrell | A44C 5/2076 24/303 |
| 2008/0173854 | A1 * | 7/2008 | Meaux | E01F 13/02 256/23 |
| 2010/0108441 | A1 * | 5/2010 | Morelli | E04G 3/28 182/82 |
| 2014/0202721 | A1 * | 7/2014 | Shaw | E06B 5/164 169/48 |
| 2024/0400351 | A1 * | 12/2024 | Ismailanji | E02D 29/1445 |

FOREIGN PATENT DOCUMENTS

| | | | | |
|---|---|---|---|---|
| GB | 2585217 | A * | 1/2021 | B66F 11/042 |
| JP | 2000345575 | A * | 12/2000 | |

* cited by examiner

MOBILE BARRIER

RELATED APPLICATION

This application claims priority to provisional patent application U.S. Ser. No. 63/215,886 filed on Jun. 28, 2021, the entire contents of which is herein incorporated by reference.

BACKGROUND

The embodiments herein relate generally to commercial/industrial safety.

Prior to embodiments of the disclosed invention, creating physical barriers, also commonly referred to as a controlled access zone (CAZ), to protect against falling objects and drop hazards incidents, potentially involving injuries to bystanders, did not allow for the barrier to remain mobile. Each time a work zone moved to a new location, the CAZ had to be manually moved to the new location, causing time delays and inefficiencies. CAZs are meant to be discernible and warn bystanders of risks and should not cause additional burden through establishing or maintaining. Embodiments of the disclosed invention solve this problem.

SUMMARY

A mobile barrier assembly is configured to create a restricted space that moves with a working platform. The mobile barrier assembly has a working platform with four corners. A marker pole is attached to each corner. A barrier line is attached to an end of the marker pole. The barrier line creates the restricted space between the barrier line and the working platform.

In some embodiments, the end of each marker pole is attached to a barrier guide through which the barrier line passes. A magnetic corner bracket can be attached to each corner on the working platform. A handle grip can be attached to each magnetic cover bracket and further comprising a plurality of marker pole openings wherein the marker pole fits into one of the plurality of marker pole openings. The magnetic cover bracket can further comprise at least two magnets each arranged inside a magnet sleeve. A cap can cover each of the magnetic sleeves.

BRIEF DESCRIPTION OF THE FIGURES

Detailed description of some embodiments of the invention is made below with reference to the accompanying figures, wherein like numerals represent corresponding parts of the figures.

DETAILED DESCRIPTION OF CERTAIN EMBODIMENTS

Figure 1:
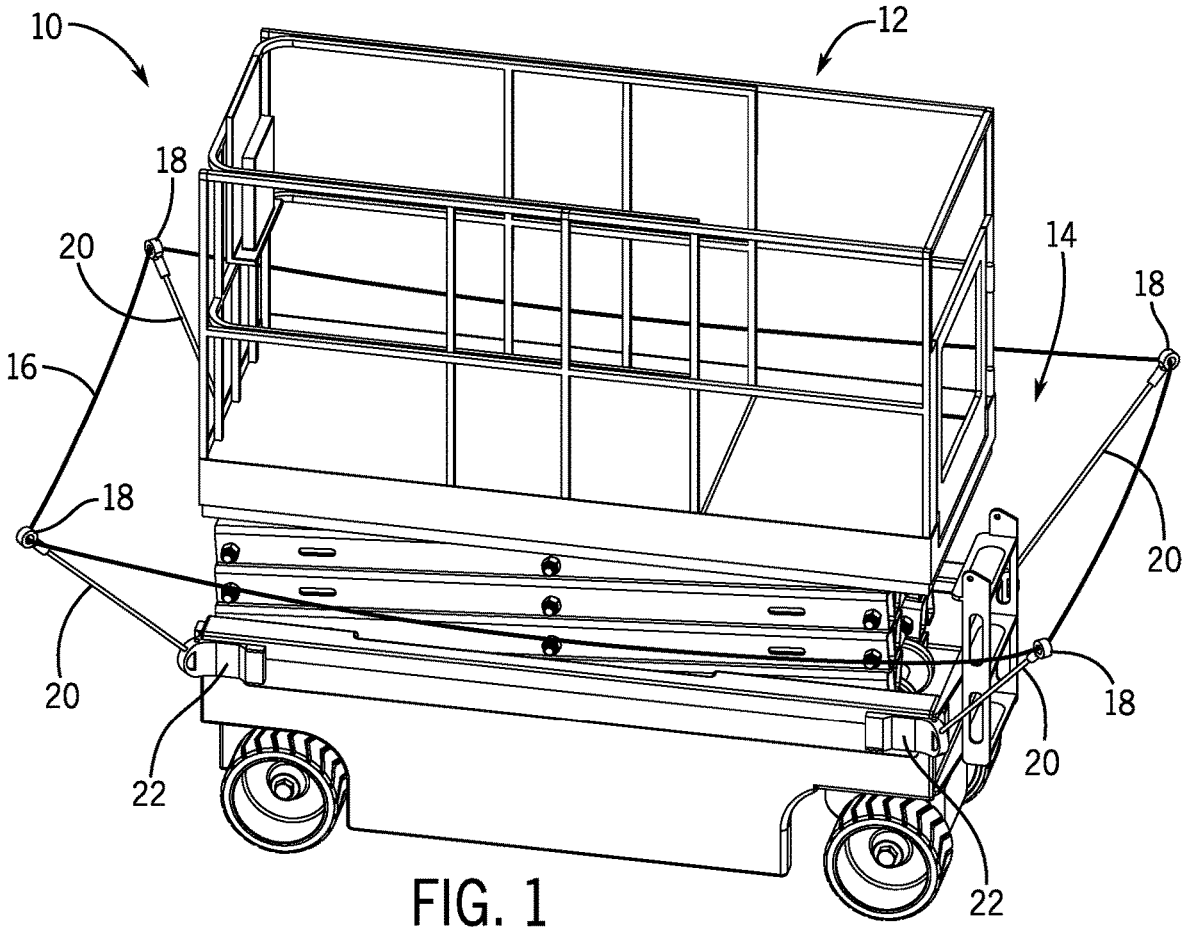
FIG. 1 shows a top perspective view of one embodiment of the present invention.
Figure 2:
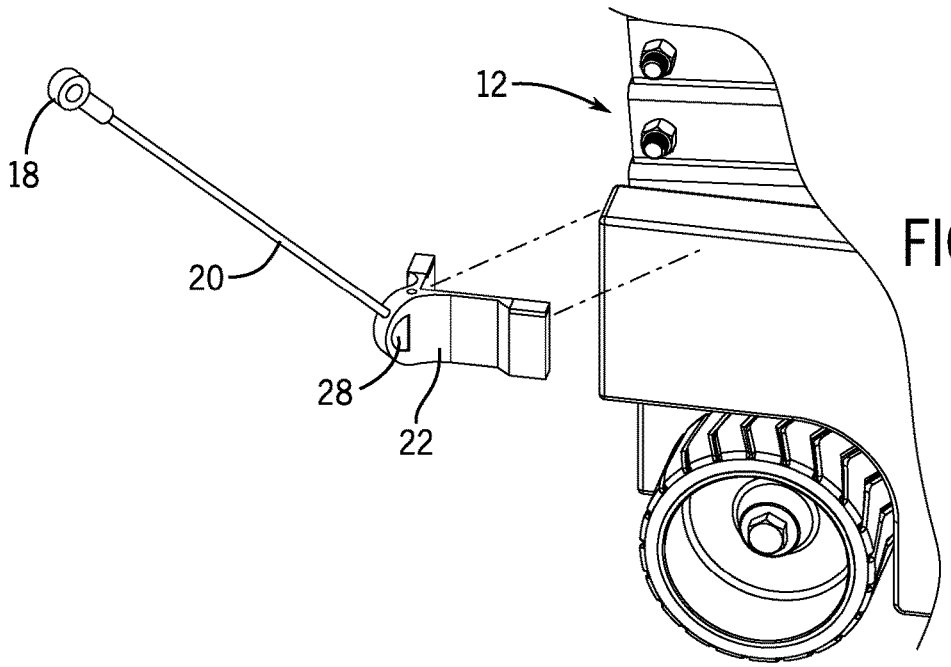
FIG. 2 shows a detailed exploded view of one embodiment of the present invention.
Figure 3:
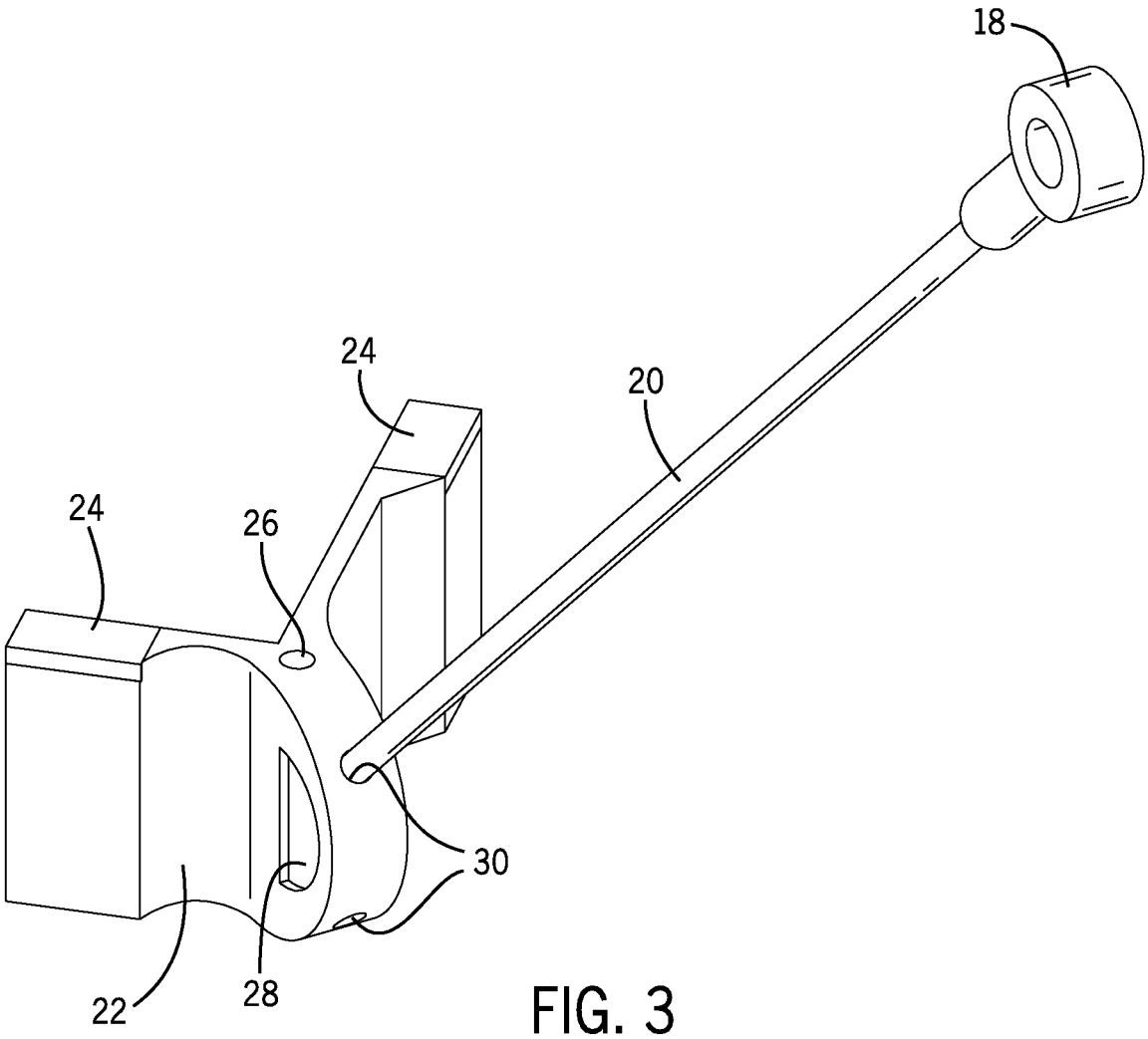
FIG. 3 shows a detailed perspective view of one embodiment of the present invention.
Figure 4:
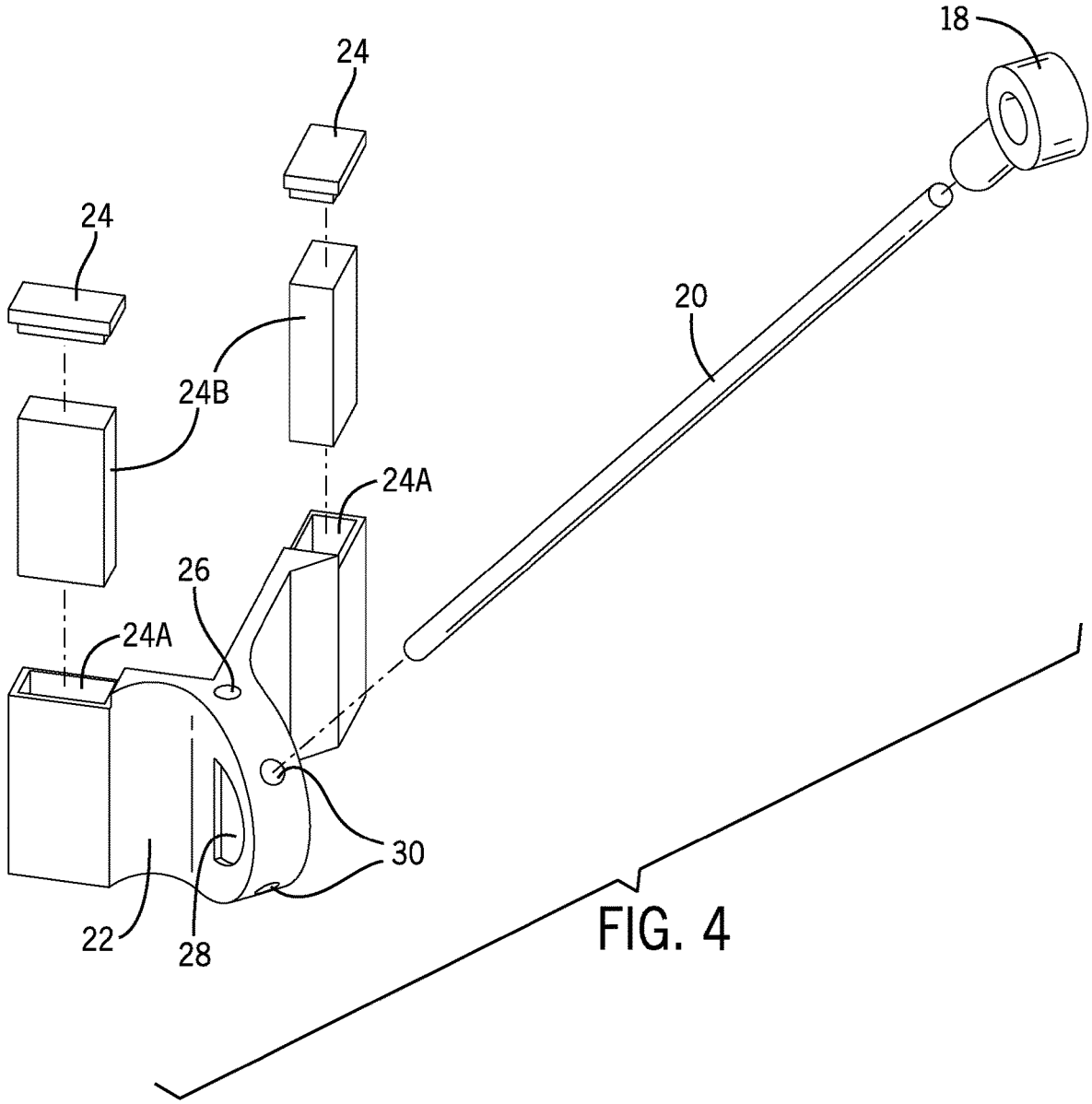
FIG. 4 shows an exploded view of one embodiment of the present invention.
Figure 5:
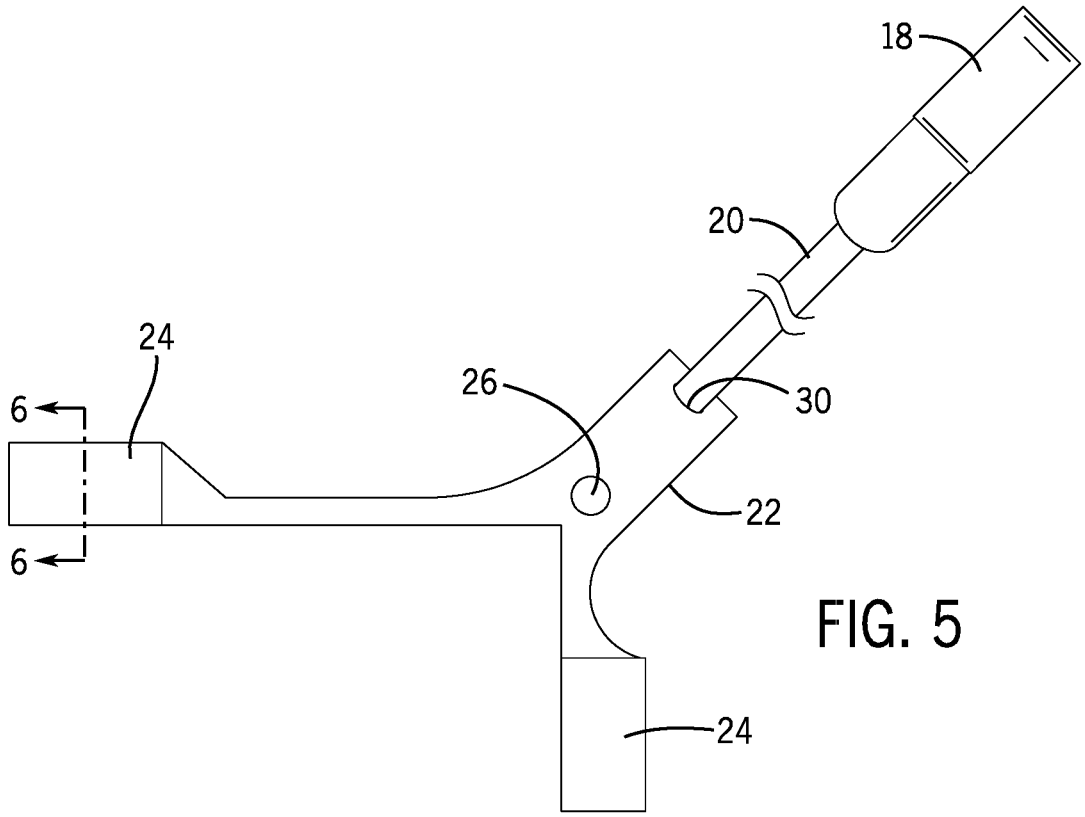
FIG. 5 shows a top plan view of one embodiment of the present invention.
Figure 6:
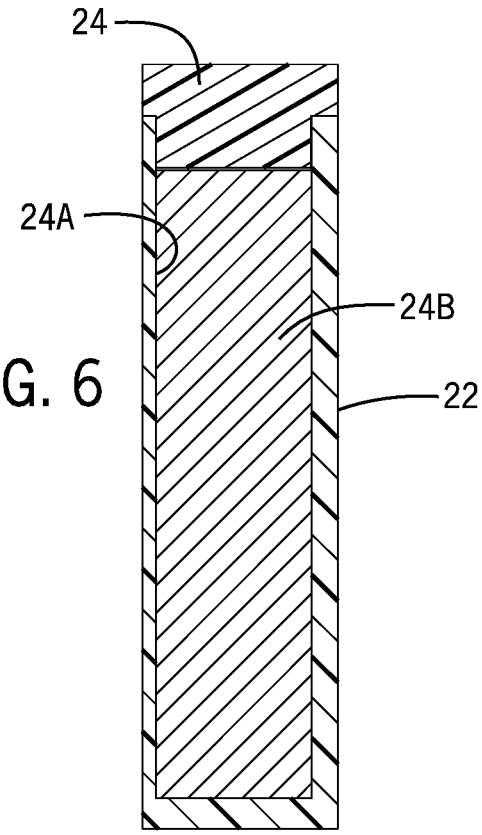
FIG. 6 shows a cross-sectional view of one embodiment of the present invention.

By way of example, and referring to FIGS. 1-6, one embodiment a mobile barrier assembly 10, configured to create a restricted space 14 that moves with a working platform 12. A working platform 12 further comprising four corners.

Surrounding the working platform is a barrier 16 that is threaded through a barrier guide 18. The barrier guide 18 is attached to a magnetic corner bracket 22 with a reflective marker pole 20. The barrier 16, can be a rope, string, chain, tube or anything effectively similar called a "barrier line" in this application.

Each magnetic corner bracket 22 further comprises a pair of magnetic sleeves 24A which house magnets 24B. There is a cap 24 arranged above each magnet 24B on the magnetic sleeve 24A.

Each magnetic corner bracket 22 further comprises a handle grip 28 with a at least one storage openings 26 and a plurality of reversible holes for the reflective marker pole 20.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶ 6. In particular, any use of "step of" in the claims is not intended to invoke the provision of 35 U.S.C. § 112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A mobile barrier assembly, configured to create a restricted space that moves with a working platform; the mobile barrier assembly consisting of:

a working platform attached to a mobile vehicle with a scissor lift; the mobile vehicle has a first corner, a second corner, a third corner, and a fourth corner;

a first magnetic corner bracket, attached to the first corner and further consisting of:

a first magnetic corner bracket first magnetic sleeve housing a first magnetic corner bracket first magnet secured with a first magnetic corner bracket first cap;

a first magnetic corner bracket second magnetic sleeve housing a first magnetic corner bracket second magnet secured with a first magnetic corner bracket second cap;

a first magnetic corner bracket handle grip further comprising a first magnetic corner bracket first storage opening, a first magnetic corner bracket second storage opening, and a first magnetic corner bracket operative opening;

a first reflective marker pole arranged into the first magnetic corner bracket operative opening and attached to a first barrier guide;

a second magnetic corner bracket, attached to the second corner and further consisting of:

a second magnetic corner bracket first magnetic sleeve housing a second magnetic corner bracket first magnet secured with a second magnetic corner bracket first cap;

a second magnetic corner bracket second magnetic sleeve housing a second magnetic corner bracket second magnet secured with a second magnetic corner bracket second cap;

a second magnetic corner bracket handle grip further comprising a second magnetic corner bracket first storage opening, a second magnetic corner bracket second storage opening, and a second magnetic corner bracket operative opening;

a second reflective marker pole arranged into the second magnetic corner bracket operative opening and attached to a second barrier guide;

a third magnetic corner bracket, attached to the third corner and further consisting of:

a third magnetic corner bracket first magnetic sleeve housing a third magnetic corner bracket first magnet secured with a third magnetic corner bracket first cap;

a third magnetic corner bracket second magnetic sleeve housing a third magnetic corner bracket second magnet secured with a third magnetic corner bracket second cap;

a third magnetic corner bracket handle grip further comprising a third magnetic corner bracket first storage opening, a third magnetic corner bracket second storage opening, and a third magnetic corner bracket operative opening;

a third reflective marker pole arranged into the third magnetic corner bracket operative opening and attached to a third barrier guide;

a fourth magnetic corner bracket, attached to the fourth corner and further consisting of:

a fourth magnetic corner bracket first magnetic sleeve housing a fourth magnetic corner bracket first magnet secured with a fourth magnetic corner bracket first cap;

a fourth magnetic corner bracket second magnetic sleeve housing a fourth magnetic corner bracket second magnet secured with a fourth magnetic corner bracket second cap;

a fourth magnetic corner bracket handle grip further comprising a fourth magnetic corner bracket first storage opening, a fourth magnetic corner bracket second storage opening, and a fourth magnetic corner bracket operative opening;

a fourth reflective marker pole arranged into the fourth magnetic corner bracket operative opening and attached to a fourth barrier guide;

a barrier line arranged through a central opening in each of the first barrier guide, the second barrier guide, the third barrier guide, and the fourth barrier guide, stretching outside of the working platform, mobile vehicle, and scissor lift;

wherein the barrier line creates the restricted space in an area between the barrier line and the working platform.

* * * * *